United States Patent [19]

Freeman et al.

[11] Patent Number: 4,578,348

[45] Date of Patent: Mar. 25, 1986

[54] HYDROLYZED AZOLIUM SPEED ENHANCING/FOG-INHIBITING AGENTS FOR SILVER HALIDE PHOTOGRAPHY

[75] Inventors: John P. Freeman; Fred M. Macon; John D. Mee, all of Rochester, N.Y.

[73] Assignee: Eastman Kodak Company, Rochester, N.Y.

[21] Appl. No.: 712,495

[22] Filed: Mar. 18, 1985

[51] Int. Cl.[4] ..... G03C 1/34

[52] U.S. Cl. ..... 430/607; 430/614; 430/612; 548/100

[58] Field of Search ..... 430/607, 614, 611, 612, 430/613, 600, 603; 548/100

[56] References Cited

U.S. PATENT DOCUMENTS

| | | | |
|---|---|---|---|
| Re. 28,668 | 12/1975 | Herz et al. | 430/614 |
| 2,131,038 | 9/1938 | Brooker et al. . | |
| 3,282,933 | 11/1966 | Nys et al. . | |
| 4,327,214 | 12/1980 | Mifune et al. | 546/133 |
| 4,374,196 | 2/1983 | Herz | 430/505 |
| 4,423,140 | 12/1983 | Herz | 430/445 |

OTHER PUBLICATIONS

*Research Disclosure,* vol. 176, Dec. 1978, Item 17643 Section VI.

*Primary Examiner*—Won H. Louie
*Attorney, Agent, or Firm*—Carl O. Thomas

[57] ABSTRACT

Radiation sensitive silver halide photographic elements are disclosed which are protected from fog by hydrolyzed quaternized chalcogenazolium salts of middle chalcogens, wherein the quaternizing substituent contains a $$-T\text{-}(NH-T^1)_m$$

group in which T and $T^1$ are carbonyl or sulfonyl and m is from 1 to 3.

18 Claims, No Drawings

HYDROLYZED AZOLIUM SPEED ENHANCING/FOG-INHIBITING AGENTS FOR SILVER HALIDE PHOTOGRAPHY

FIELD OF THE INVENTION

This invention relates to photography. It relates more specifically to silver halide photographic elements.

BACKGROUND OF THE INVENTION

In the course of processing a photographic element containing an imagewise exposed silver halide emulsion layer, reduced silver can be formed either as a direct or inverse function of exposure. At the same time, at least a low level of reduced silver formation also occurs independently of imagewise exposure. The term "fog" is herein employed to indicate the density of the processed photographic element attributable to the latter, usually measured in minimum density areas. In color photography, fog is typically observed as image dye density rather than directly as silver density.

A common disadvantage of fog-inhibiting agents is that they concurrently inhibit fog and reduce photographic speed to an increasing degree as they are increased in concentration in a silver halide emulsion. Thus, the choice of a particular fog inhibiting agent for use in a silver halide emulsion is based on both fog and photographic speed considerations, hereinafter referred to as speed/fog relationships.

Over the years a variety of differing materials have been introduced into silver halide emulsions to inhibit the formation of fog. *Research Disclosure,* Vol. 176, December 1978, Item 17643, Section VI, lists the more commonly employed fog inhibiting agents. *Research Disclosure* is published by Kenneth Mason Publications, Ltd., The Old Harbourmaster's, 8 North Street, Emsworth, Hampshire P010 7DD, England.

It has been generally recognized in the art that a particularly effective class of fog-inhibiting agents is comprised of quaternized thiazolium and selenazolium salts. By contrast quaternized oxazolium salts are not effective fog-inhibiting agents.

Brooker et al U.S. Pat. No. 2,131,038 discloses thiazolium salts, including a simple cyanine dye, to be useful fog-inhibiting agents. Mifune et al U.S. Pat. No. 4,237,214 discloses benzothiazolum salts having quaternizing substituents that can contain a carbamoyl or sulfamoyl group.

Gunther et al U.S. Ser. No. 660,155, filed Oct. 14, 1984, titled PHOTOGRAPHICALLY USEFUL CHALCOGENAZOLES, CHALCOGENAZOLINES, AND CHALCOGENAZOLINIUM AND CHALCOGENAZOLIUM SALTS, commonly assigned, discloses the preparation of aromatic tellurazolium salts and their utility as antifoggants.

In addition to the foregoing patents relating to fog-inhibiting agents, the following patents are of interest by reason of compound fragment similarities:

Nys et al U.S. Pat. No. 3,282,933 discloses polymethine dyes having a quaternizing substituent containing a divalent —CO—HN—$SO_2$— group.

Herz U.S. Pat. Nos. 4,374,196 and 4,423,140 teach hydrolyzed quaternized chalcogenazolium salts to be useful latent image stabilizers in silver halide emulsions where the nitrogen atom contained in the ring prior to hydrolysis is substituted with an allyl group which may in turn be optionally substituted with an alkyl, alkoxy, carboxy, alkoxycarbonyl, or aminocarbonyl group.

SUMMARY OF THE INVENTION

In one aspect this invention is directed to a photographic element containing a radiation sensitive silver halide emulsion and a photographically effective amount of a hydrolyzed quaternized chalcogenazolium salt of a middle chalcogen including a quaternizing substituent having a carbon chain interrupted by a divalent group of the formula:

$$-L-T-(\overset{H}{N}-T^1)_m-R$$

where:

L is a divalent linking group;

R is a hydrocarbon residue or an amino group;

T is carbonyl or sulfonyl;

$T^1$ is independently in each occurrence carbonyl or sulfonyl; and m is an integer of from 1 to 3.

The present invention permits the use of photographic elements containing radiation sensitive silver halide emulsions to produce photographic images exhibiting low levels of fog. Further, the invention permits a speed/fog relationship to be realized that is superior to that of known fog-inhibiting agents closely related in structural form.

DESCRIPTION OF PREFERRED EMBODIMENTS

From observations of a variety of quaternized chalcogenazolium salts of middle chalcogens incorporated in silver halide emulsions it has been noted that some are effective fog-inhibiting agents while others are as ineffective as oxazolium salts. After some study it has been concluded that those of the above compounds which are effective as fog-inhibiting agents are capable of undergoing hydrolysis which opens the chalcogenazolium ring between the 1 and 2 ring positions—that is, between the ring chalcogen atom and the carbon atom which lies mediate the ring chalcogen and nitrogen atoms.

To provide a specific illustration, it has been recognized that compounds of the following general formula can be employed as fog-inhibiting agents when hydrolyzed:

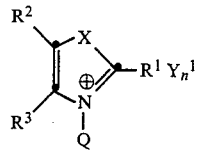

(I)

wherein $R^1$ is hydrogen, alkyl of from 1 to 8 carbon atoms, or aryl of from 6 to 10 carbon atoms;

$R^2$ and $R^3$ are independently hydrogen or halogen atoms; aliphatic or aromatic hydrocarbon moieties optionally linked through a divalent oxygen or sulfur atom; or cyano, amino, amido, sulfonamido, sulfamoyl, ureido, thioureido, hydroxy, —C(O)M, or —$S(SO)_2M$ groups, wherein M is chosen to complete an aldehyde, ketone, acid, ester, thioester, amide, or salt; or $R^2$ and $R^3$ together represent the atoms completing a fused ring;

Q represents a quaternizing substituent;

X is a middle chalcogen atom;

Y represents a charge balancing counter ion; and n is the integer 0 or 1.

Heretofore the art has found to be useful as fog-inhibiting agents only those quaternized chalcogenazolium salts of middle chalcogens which are herein recognized to undergo spontaneous hydrolysis when incorporated in the silver halide emulsion layer of a photographic element. Although sweeping characterizations of $R^1$ substituents are published, in fact the art has seldom successfully employed $R^1$ substituents other than hydrogen or methyl.

By recognizing the importance of ring hydrolysis to fog-inhibiting activity, it is now possible to hydrolyze quaternized chalcogenazolium salts of middle chalcogens deliberately. Where $R^1$ is hydrogen and, in some instances methyl, ring opening occurs spontaneously after incorporating the compound of formula (I) in a silver halide emulsion. However, when the pH of silver halide emulsions is too low for ring opening hydrolysis, treatment with a base, such as an aqueous alkaline solution of an alkali hydroxide, alaline earth hydroxide, or ammonium hydroxide can be employed prior to incorporation in the silver halide emulsion.

Whether prehydrolyzed or spontaneously hydrolyzed in situ, the effective fog-inhibiting compounds which can be derived by hydrolysis of the compounds of formula (I) can be represented by formula (II):

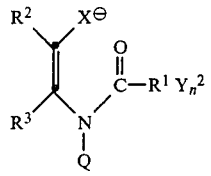

(II)

wherein $R^1$, $R^2$, $R^3$, Q, X, and n are as previously defined and $Y^2$ is a charge balancing counter ion.

An improved speed/fog relationship can be realized by modification of the quaternizing substituent of any quaternized chalcogenazolium salt of a middle chalcogen which is capable of undergoing hydrolysis in the manner indicated. Conventional quaternizing substituents are optionally substituted hydrocarbon substituents, sometimes including a carbon chain interrupting group, such as an oxy, carboxy, carbamoyl, or sulfonamido group. It is the specific recognition of this invention that an improved speed/fog relationship can be realized by including a quaternizing substituent having a divalent group satisfying formula (III):

$$-T\overset{H}{\leftarrow}N-T^1\rightarrow_m \qquad \text{(III)}$$

where:

T and $T^1$ are independently carbonyl (CO) or sulfonyl ($SO_2$) and m is an integer of from 1 to 3.

In a specific preferred form the quaternizing substituent, e.g. Q, can take the form represented by formula (IV):

$$-L-T\overset{H}{\leftarrow}N-T^1\rightarrow_m R \qquad \text{(IV)}$$

wherein

T is carbonyl or sulfonyl;

$T^1$ is independently in each occurrence carbonyl or sulfonyl; and

L represents a divalent linking group, such as an optionally substituted divalent hydrocarbon group;

R represents an optionally substituted hydrocarbon residue or an amino group; and m is an integer of from 1 to 3.

In preferred embodiments of the invention T is carbonyl and $T^1$ is sulfonyl. However, either or both of T and $T^1$ can be either carbonyl or sulfonyl. Further, where m is greater than 1, $T^1$ can in each occurrence be carbonyl or sulfonyl independently of other occurrences.

L is preferably an alkylene (i.e., alkanediyl) group of from 1 to 8 carbon atoms. In specifically preferred forms of the invention L is either methylene ($-CH_2-$) or ethylene ($-CH_2CH_2-$).

R is preferably a primary or secondary amino group, an alkyl group of from 1 to 8 carbon atoms (e.g., methyl, ethyl, propyl, i-propyl, n-butyl, i-butyl, t-butyl, neopentyl, or n-octyl), or an aryl group of from 6 to 10 carbon atoms (e.g., phenyl or naphthyl). When R completes a secondary amine, it can be substituted with an optionally substituted hydrocarbon residue, preferably an alkyl group of from 1 to 8 carbon atoms or an aryl group of 6 to 10 carbon atoms, as above described. It is also recognized that R can be chosen, if desired, to complete a bis compound. For example, R can take a form similar to L and the hydrolyzed chalcogenazolium ring linked to L, thereby incorporating a second hydrolyzed chalcogenazolium ring into the fog-inhibiting agent.

m is in a preferred form of the invention the integer 1.

Although preferred values of $R^1$ are described above in connection with formulae (I) and (II), it is appreciated that $R^1$ can take the form of any other substituent that is compatible with ring opening hydroylsis of the chalcogenazolium salt in the manner indicated. In general, as noted above, the simpler the form of $R^1$, the more easily hydrolysis is accomplished. Conversely, $R^1$ cannot complete a carbocyanine or hemicarbocyanine dye, since ring opening hydrolysis in the manner contemplated has not been achieved. It is specifically recognized that $R^1$ can embrace substituents that do not permit spontaneous hydrolysis of quaternized chalcogenazolium salts in silver halide emulsion coatings.

X, $R^2$, and $R^3$ can together complete any convenient chalcogenazolium nucleus or hydrolyzed chalcogenazolium nucleus, provided the chalcogen atom is a middle chalcogen atom. The middle chalcogen atoms are sulfur, selenium, and tellurium, being designated "middle" chalcogen atoms since they are the atoms in Group VI of the Periodic Table of Elements, except the highest and lowest in atomic number. When oxygen is employed instead of a middle chalcogen atom, fog-inhibiting activity is largely absent.

When X is sulfur or selenium, $R^2$ and $R^3$ can take any form found in known thiazolium and selenazolium ring containing nuclei. $R^2$ and $R^3$ can individually take the form of hydrogen or halogen atoms; hydrocarbon moieties (e.g., alkyl, aryl, alkaryl, or aralkyl) optionally linked through a divalent oxygen or sulfur atom (e.g., an alkoxy, aryloxy, alkaryloxy, aralkoxy, alkylthio, arylthio, alkarylthio, or aralkylthio group); cyano; an amino group, including primary, secondary, and tertiary amino groups; an amido group (e.g., acetamido and butyramido); a sulfonamido group (e.g., an alkyl or arylsulfonamido group); a sulfamoyl group (e.g., an alkyl or arylsulfamoyl group); a ureido group (e.g., 1-ureido, 3-phenyl-1-ureido, or 3-methyl-1-ureido); a thioureido group (e.g., a thioureido group corresponding to the above exemplary ureido groups); hydroxy; or a —C(O)M or —$S(O)_2M$ group, wherein M is chosen to complete an aldehyde, ketone, acid, ester, thioester, amide, or salt (e.g., —C(O)H, —$C(O)CH_3$, —C(O)OH, —$C(O)SCH_3$, —$C(O)OCH_3$, —$C(O)NH_2$, —C(O)ONa, —$S(O)_2OH$, —$S(O)_2OCH_2C_6H_5$, —$S(O)_2NH_2$, or —$S(O)_2OLi$).

The alkyl groups and the alkyl moieties of other groups preferably contain from 1 to 8 carbon atoms (e.g., methyl, ethyl, propyl, butyl, amyl, hexyl, or octyl), and most preferably contain from 1 to 4 carbon atoms and may be further substituted by other groups, such as halogen, cyano, aryl, carboxy, alkylcarbonyl, arylcarbonyl, arylcarbonyl, and aminocarbonyl.

The aryl groups and the aryl moieties of other groups preferably contain 6 to 10 carbon atoms (e.g., phenyl or naphthyl) and include substituted or unsubstituted groups. Useful substituents include halogen, cyano, alkyl, carboxy, alkylcarbonyl, arylcarbonyl, alkoxycarbonyl, aryloxycarbonyl, and aminocarbonyl.

In a preferred form, $R^2$ and $R^3$ together form one or more fused carbocyclic aromatic rings—e.g., a benzo or naphtho ring, either of which can be optionally substituted. When X is sulfur or selenium, the salt can be a benzothiazolium salt, a benzoselenazolium salt, an $\alpha$ or $\beta$-naphthothiazolium salt, or an $\alpha$ or $\beta$-naphthoselenazolium salt, such as the quaternized but otherwise unsubstituted salts or the salts in which the fused carbocyclic rings are substituted. Fused carbocyclic ring substituents, when present, can be chosen from among those identified above for $R^2$ and $R^3$ as individual substituents. In general, the fused carbocyclic ring substituents, when present, can be chosen from among those present in comparable nuclei in cyanine, merocyanine, and hemicyanine dyes.

When the middle chalcogen represented by X is tellurium, $R^2$ and $R^3$ together form a carbocyclic aromatic ring, such as a fused benzo or $\alpha$ or $\beta$-naphtho ring. The fused carbocyclic aromatic rings can be unsubstituted or substituted with aliphatic or aromatic groups comprised of hydrocarbon moieties optionally linked through a divalent oxygen or sulfur atom, amino groups, amido groups, sulfonamido groups, sulfamoyl groups, ureido groups, thioureido groups, hydroxy groups, C(O)M groups, and $SO_2M$ groups, wherein M is chosen to complete an acid, ester, thioester, or salt. Specifically preferred benzo or naphtho ring substituents are alkyl, alkoxy, alkylthio, and hydroxy substituents, where alkyl is preferably of from 1 to 8 carbon atoms, and most preferably of from 1 to 4 carbon atoms.

$Y^1$ and $Y^2$ are included in formulae (I) and (II) to provide electronically neutral compounds. $Y^1$ and $Y^2$ can be chosen from a wide range of known anions and cations known to be compatible with silver halide emulsions. When the chalcogenazolium salt or the hydrolyzed chalcogenazolium salt is a betaine, no charge balancing counter ion may be required, and n can be zero. In the absence of an ionized substituent, the quaternized chalcogenazolium salt of formula (I) has a single positive charge and $Y^1$ is an acid anion, such as a halide or p-toluenesulfonate. In the absence of an ionized substituent, the hydrolyzed quaternized chalcogenazolium salt of formula (II) has a single negative charge and $Y^2$ is a cation, such as that provided by the base employed to effect hydrolysis—e.g., an alkali, alkaline earth, or ammonium cation.

The hydrolyzed quaternized chalcogenazolium salt fog-inhibiting agents are incorporated in the photographic element to be protected prior to exposure and processing—e.g., at the time of manufacture. It is essential that the hydrolyzed quaternized chalcogenazolium salt fog-inhibiting agent be incorporated in the silver halide emulsion layer or layers to be protected. The hydrolyzed quaternized chalcogenazolium salt can be conveniently introduced into the silver halide emulsion to be protected at any time after precipitation of the emulsion and before coating.

Any amount of hydrolyzed quaternized chalcogenazolium salt effective to inhibit fog can be employed. Optimum amounts of fog-inhibiting agents for specific applications are usually determined empirically by varying concentrations. Such investigations are typically relied upon to identify optimum fog-inhibiting concentrations or an optimum balance between fog-inhibition and other effects, such as reduction in photographic speed. Based on the investigations reported below, the quaternized chalcogenazolium salt is incorporated in a silver halide emulsion prior to coating in concentrations of from about 10.0 to 0.1 millimole per silver mole, preferably 2.0 to 0.015 millimole per silver mole.

It is, of course, recognized that conventional fog-inhibiting agents, such as those illustrated by *Research Disclosure,* Item 17643, Section VI, cited above, can be employed in combination with hydrolyzed quaternized chalcogenazolium salts in the practice of this invention. Since it is recognized that fog-inhibiting agents operate by a variety of differing mechanisms, the effects produced by combinations of hydrolyzed quaternized chalcogenazolium salts and conventional fog-inhibiting agents will range from highly interdependent to independently additive, but in any case optimum concentrations are susceptible to empirical determination.

In addition to the fog-inhibiting agent this invention additionally requires a photographic element containing a radiation sensitive silver halide emulsion. These silver halide emulsions can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains of either regular (e.g., cubic or octahedral) or irregular (e.g., multiply twinned or tabular) crystallographic form. Recently developed high aspect ratio tabular grain emulsions, such as those disclosed by Wilgus et al U.S. Pat. No. 4,434,226, Daubendiek et al U.S. Pat. No. 4,414,310, Wey U.S. Pat. No. 4,399,215, Solberg et al U.S. Pat. No. 4,433,048, Mignot U.S. Pat. No. 4,386,156, Evans et al U.S. Ser. No. 553,911, filed Nov. 21, 1983, commonly assigned, Maskasky U.S. Pat. No. 4,400,463, Wey et al U.S. Pat. No. 4,414,306, and Maskasky U.S. Pat. No. 4,435,501, are specifically contemplated. Sensitizing compounds, such as compounds of copper, thallium, lead, bismuth, cadmium and Group VIII noble metals, can be present during precipitation of the silver halide emulsion, as illustrated by Arnold et al U.S. Pat. No. 1,195,432, Hochstetter U.S. Pat. No. 1,951,933, Trivelli et al U.S. Pat. No. 2,448,060, Overman U.S. Pat. No. 2,628,167, Mueller et al U.S. Pat. No. 2,950,972, Sidebotham U.S. Pat. No. 3,488,709 and Rosecrants et al U.S. Pat. No. 3,737,313.

The silver halide emulsions can be either monodispersed or polydispersed as precipitated. The grain size distribution of the emulsions can be controlled by silver halide grain separation techniques or by blending silver halide emulsions of differing grain sizes. The emulsions can include Lippmann emulsions and ammoniacal emulsions, as illustrated by Glafkides, *Photographic Chemistry,* Vol. 1, Fountain Press, London, 1958, pp.365–368 and pp.301–304; excess halide ion ripened emulsions as described by G. F. Duffin, *Photographic Emulsion Chemistry,* Focal Press Ltd., London, 1966, pp.60–72; thiocyanate ripened emulsions, as illustrated by Illingsworth U.S. Pat. No. 3,320,069; thioether ripened emulsions, as illustrated by McBride U.S. Pat. No. 3,271,157, Jones U.S. Pat. No. 3,574,628 and Rosecrants et al U.S. Pat. No. 3,737,313 or emulsions containing weak silver halide solvents, such as ammonium salts, as illustrated by Perignon U.S. Pat. No. 3,784,381 and *Research Disclosure,* Vol. 134, June 1975, Item 13452.

The emulsions can be surface-sensitive emulsions—i.e., emulsions that form latent images primarily on the surfaces of the silver halide grains—or internal latent image-forming emulsions—i.e., emulsions that form latent images predominantly in the interior of the silver halide grains, as illustrated by Knott et al U.S. Pat. No. 2,456,953, Davey et al U.S. Pat. No. 2,592,250, Porter et al U.S. Pat. Nos. 3,206,313 and 3,317,322, Bacon et al U.S. Pat. No. 3,447,927, Evans U.S. Pat. No. 3,761,276, Morgan U.S. Pat. No. 3,917,485, Gilman et al U.S. Pat. No. 3,979,213 and Miller U.S. Pat. No. 3,767,413.

The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent, as illustrated by Ives U.S. Pat. No. 2,563,785, Evans U.S. Pat. No. 3,761,276, Knott et al U.S. Pat. No. 2,456,953 and Jouy U.S. Pat. No. 3,511,662.

Blends of surface sensitive emulsions and internally fogged, internal latent image-forming emulsions can be employed, as illustrated by Luckey et al U.S. Pat. Nos. 2,996,382, 3,397,987 and 3,705,858, Luckey U.S. Pat. No. 3,695,881, *Research Disclosure,* Vol. 134, June 1975, Item 13452, Millikan et al Defensive Publication T-904017, Apr. 21, 1972 and Kurz *Research Disclosure,* Vol. 122, June 1974, Item 12233.

The hydrolyzed quaternized chalcogenazolium salts are preferably employed to inhibit fog in negative working silver halide emulsions and most preferably those that contain silver halide grains which form surface latent images on exposure.

The silver halide emulsions can be surface sensitized. Noble metal (e.g., gold), middle chalcogen (e.g., sulfur, selenium, or tellurium), and reduction sensitizers, employed individually or in combination are specifically contemplated. Typical chemical sensitizers are listed in *Research Disclosure,* Item 17643, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyanines. Illustrative spectral sensitizing dyes are disclosed in *Research Disclosure,* Item 17643, cited above, Section IV.

The silver halide emulsions as well as other layers of the photographic elements of this invention can contain as vehicles hydrophilic colloids, employed alone or in combination with other polymeric materials (e.g., lattices). Suitable hydrophilic materials include both naturally occurring substances such as proteins, protein derivatives, cellulose derivatives—e.g., cellulose esters, gelatin—e.g., alkali treated gelatin (cattle, bone, or hide gelatin) or acid treated gelatin (pigskin gelatin), gelatin derivatives—e.g., acetylated gelatin, phthalated gelatin, and the like, polysaccharides such as dextran, gum arabic, zein, casein, pectin, collagen derivatives, collodion, agar-agar, arrowroot, and albumin. The vehicles can be hardened by conventional procedures. Further details of the vehicles and hardeners are provided in *Research Disclosure,* Item 17643, cited above, Sections IX and X.

The silver halide photographic elements of this invention can contain other addenda conventional in the photographic art. Useful addenda are described, for example, in *Research Disclosure,* Item 17643, cited above. Other conventional useful addenda include desensitizers, couplers (such as dye forming couplers, masking couplers and DIR couplers) DIR compounds, anti-stain agents, image dye stabilizers, absorbing materials such as filter dyes and UV absorbers, light scattering materials, antistatic agents, coating aids, plasticizers and lubricants, and the like.

The photographic elements of the present invention can be simple black-and-white or monochrome elements comprising a support bearing a layer of the silver halide emulsion, or they can be multilayer and/or multicolor elements. The photographic elements produce images ranging from low contrast to very high contrast, such as those employed for producing half tone images in graphic arts. They can be designed for processing with separate solutions or for in-camera processing. In the latter instance the photographic elements can include conventional image transfer features, such as those illustrated by *Research Disclosure,* Item 17643, cited above, Section XXIII. Multicolor elements contain dye image forming units sensitive to each of the three primary regions of the spectrum. Each unit can be comprised of a single emulsion layer or of multiple emulsion layers sensitive to a given region of the spectrum. The layers of the element, including the layers of the image forming units, can be arranged in various orders as known in the art. In an alternative format, the emulsion or emulsions can be disposed as one or more segmented layers, e.g., as by the use of microvessels or microcells, as described in Whitmore U.S. Pat. No. 4,387,154.

A preferred color photographic element according to this invention comprises a support bearing at least one blue sensitive silver halide eulsion layer having associated therewith a yellow dye forming coupler, at least one green sensitive silver halide emulsion layer having associated therewith a magenta dye forming coupler and at least one red sensitive silver halide emulsion layer having associated therewith a cyan dye forming coupler, at least one of the silver halide emulsion layers containing a hydrolyzed quaternized chalcogenazolium salt fog-inhibiting compound.

The elements of the present invention can contain additional layers conventional in photographic elements, such as overcoat layers, spacer layers, filter layers, antihalation layers, scavenger layers and the like. The support can be any suitable support used with photographic elements. Typical supports include polymeric films, paper (including polymer-coated paper), glass and the like. Details regarding supports and other layers of the photographic elements of this invention are contained in *Research Disclosure,* Item 17643, cited above, Section XVII.

The photographic elements can be imagewise exposed with various forms of energy, which encompass the ultraviolet, visible, and infrared regions of the electromagnetic spectrum as well as electron beam and beta radiation, gamma ray, X-ray, alpha particle, neutron radiation, and other forms of corpuscular and wave-like radiant energy in either noncoherent (random phase) forms or coherent (in phase) forms, as produced by lasers. When the photographic elements are intended to be exposed by X-rays, they can include features found in conventional radiographic elements, such as those illustrated by *Research Disclosure,* Vol. 184, August 1979, Item 18431.

Processing of the imagewise exposed photographic elements can be accomplished in any convenient conventional manner. Processing procedures, developing agents, and development modifiers are illustrated by *Research Disclosure,* Item 17643, cited above, Sections XIX, XX, and XXI, respectively. Residual dye stain attributable to sensitizing or filter dyes can be removed by processing in an aqueous alkali nitrite bath buffered to a pH of about 5.

APPENDIX

Preparation of Quaternized Chalcogenazolum Salts

The quaternized thiazolium and selenazolium salts, such as those satisfying formula (I), can be prepared by first preparing the corresponding protonated thiazolium or selenazolium salt. The latter can be purchased or prepared by procedures well known in the art, as illustrated by Brooker et al U.S. Pat. No. 2,131,038. Quaternization can be achieved by employing Cl-Q or Br-Q, where Q is chosen to satisfy the requirements of the invention. Such compounds are disclosed by Nys et al U.S. Pat. No. 3,282,933.

Preparations of protonated tellurazolium salts heretofore published have been speculative and in actuality inoperative. Successful preparations of protonated tellurazolium salts are taught by Gunther et al U.S. Ser. No. 660,155, filed Oct. 14, 1984, titled PHOTOGRAPHICALLY USEFUL CHALCOGENAZOLES, CHALCOGENAZOLINES, AND CHALCOGENAZOLINIUM AND CHALCOGENAZOLIUM SALTS, commonly assigned. To form the quaternized tellurazolium salt, the protonated tellurazolium salt can be deprotonated by treatment with a base to form the corresponding tellurazole. The tellurazole can be converted to the corresponding tellurazoline by a conventional 2,3-addition reaction. A quaternizing agent can be employed to convert the tellurazole or tellurazoline to the corresponding quaternized tellurazolium or tellurazolinium salt.

A first process for preparing a protonated tellurazolium salt, such as a protonated salt satisfying formula (V), employs a starting material satisfying formula (VI).

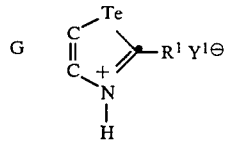

(V)

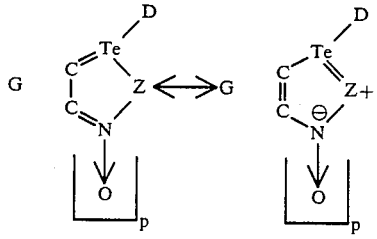

(VI)

wherein

G represents the atoms completing a fused aromatic nucleus, $R^1$ is an optionally substituted hydrocarbon moiety, p is zero or 1, D is halogen, $Y^1$ is an anion, Z is —O— or —N(R′)—, and R′ is an aromatic nucleus.with a strong alkaline reducing agent.

When p is zero and Z is —N(R′)—, the starting material can be (2-phenylazophenyl-C,N′)tellurium(II) chloride, the preparation of which is described by Cobbledick et al, "Some New Organotellurium Compounds Derived from Azobenzene: The Crystal and Molecular Structure of (2-Phenylazophenyl-C,N′)tellurium(II) Chloride", *Journal of Chemical Research,* pp. 1901–1924, 1979. Although Cobbledick et al employed chloride as the halogen corresponding to D in formula (VI), it is apparent from the reported synthesis that D can be halogen (employed here to designate generically chloride, bromide, or iodide). Similarly, G and R′ can be varied merely by substituting for one or both of the phenyl groups employed in the phenylazophenyl employed by Cobbledick et al an alternative aromatic nucleus. In general the aromatic nuclei, which form G in each of its various occurrences and are referred to in other occurrences variously as aromatic rings, nuclei, or aryl groups or moieties, are preferably carbocyclic aromatic nuclei having from 6 to 20 carbon atoms, most preferably a phenyl or naphthyl or, in the fused form, a benzo or naphtho, nucleus. In some instances an aromatic nucleus can be fused through a five-membered ring, as is illustrated by acenaphthylene fused at its 1,2 ring edge. Since R′ has little influence on the reaction and is not incorporated in the final product, R′ can take a particularly wide variety of aromatic forms, but is generally most conveniently chosen from among the preferred forms of carbocyclic aromatic nuclei.

In an alternative form the first process can employ a starting material according to formula (VI) in which p is zero and Z is oxygen. This compound can be formed by placing in solution an optionally substituted α-tetralone, hydrochloric or hydrobromic acid, tellurium dioxide, and hydroxylamine. This reaction has the advantage that all of the required materials are readily available at relatively low cost. Alcohols are convenient solvents for the reaction, although other nonreactive organic solvents can be employed. Heating is not required, but can accelerate the reaction. The material of formula (VI) forms a solid phase which can be separated by routine filtering and washing steps. Both unsubstituted α-tetralone and various substituted derivatives are useful. Preferred α-tetralones can be represented by the formula:

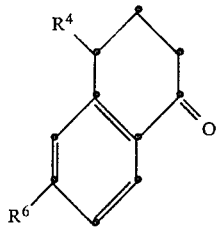

(VII)

wherein $R^4$ and $R^6$ are independently selected from among hydrogen, halogen, alkyl, and alkoxy. Since $R^4$ and $R^6$ are naphtho ring substituents in the tellurazolium salt ultimately produced, it is apparent that the number of carbon atoms in the alkyl and alkoxy substituents can be widely varied. Instead of employing an α-tetralone, as described above, it is possible to employ a substituted or unsubstituted acenaphthen-1-one.

In general alkyl substituents and moieties of the tellurazolium salts and their derivatives are limited only by physical considerations, such as solubility, mobility, and molecular bulk. Generally alkyl and other aliphatic moieties of the tellurazolium salts and their derivatives of this invention are contemplated to contain up to 18 or more carbon atoms. Since increasing molecular bulk, except as sometimes required to reduce mobility, is seldom desirable in photographic applications, the preferred aliphatic hydrocarbon moieties contain up to 6 carbon atoms, with the lower alkyls (i.e., methyl, ethyl, propyl, and butyl) being preferred. In general, references to cycloalkyl indicate groups having 4 to 10 carbon atoms in a ring, with 5 or 6 ring carbon atoms being preferred.

Instead of preparing the starting material of formula (VI) wherein p is zero and Z is oxygen in the manner described above, an oxime of an α-tetralone or acenaphthen-1-one described above can be reacted with tellurium tetrahalide, preferably tellurium tetrachloride or tellurium tetrabromide. In this and subsequent descriptions of employing tellurium tetrahalides as reactants it should be borne in mind that similar results can usually be obtained by reacting, before or during the α-tetralone or acenaphthen-1-one or reaction, a soluble halide salt, such as an alkali or alkaline earth halide, with tellurium dioxide. This is believed to generate a tellurium tetrahalide. A carboxylic acid can be employed as a solvent for the reaction, and the reaction can be accelerated by heating. The starting material of formula (VI) forms a solid phase which can be separated by routine filtering and washing procedures. The preferred α-tetralone oximes correspond to the preferred α-tetralones and can be represented by the formula:

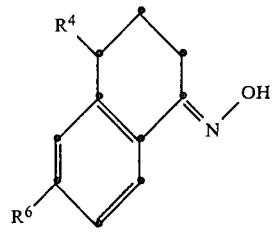

(VIII)

wherein $R^4$ and $R^6$ are chosen as described above.

In a third general form of the starting material of formula (VI) p can be 1 and Z oxygen. This form of the starting material of formula (VI) can be prepared by reacting with tellurium tetrahalide a carbocyclic aromatic compound activated for electrophilic substitution. Although naphthalene is illustrative of a fused ring carbocycylic aromatic compound that has been activated for electrophilic substitution, it is generally easiest to activate benzene. Activation can be achieved by employing electron donating substituents, such as hydroxy, hydroxyalkyl, alkyl, alkoxy, aryloxy, hydroxyaryl, amino, and groups of similar negative Hammett sigma values, singly or in combination. The reaction can be carried out in an organic solvent such as a liquid hydrocarbon (e.g., benzene or cyclohexane), a halohydrocarbon (e.g., chlorobenzene or chloroform), a nitrohydrocarbon (e.g., nitromethane), or acetonitrile while heating to reflux. Formation of the starting material of formula (VI) can be completed by nitrating and then treating with a reducing agent. Strong reducing agents can be employed in precisely stoichiometric concentrations or less. It is generally preferred to employ a mild or dilute reducing agent. Nitric acid in a suitable diluent, such as water or carboxylic acid, can be used for nitrating while hypophosphorous acid can be employed as the mild reducing agent. The synthetic route described above can be modified by a preliminary treatment with the mild reducing agent before nitrating and employing a strong nonoxidizing acid after nitrating and before employing the mild reducing agent a second time. In general the strong nonoxidizing acids contemplated for use in this and other steps of the preparation procedures herein described include acids such as hydrochloric acid, hydrobromic acid, sulfuric acid, fluoroboric acid, a sulfonic acid, and phosphoric acid.

A particularly preferred starting material prepared by the process described in the preceding paragraph can be represented by the formula:

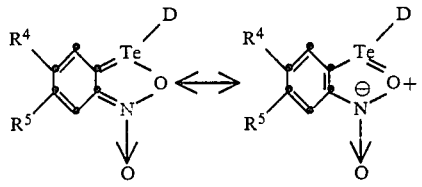

(IX)

wherein at least one of $R^4$ and $R^5$ and preferably both are chosen from among hydroxy, hydroxyalkyl, alkyl, alkoxy, aryloxy, hydroxyaryl, and amino groups. Alternately $R^4$ and $R^5$ together can form an alkanediyldioxy linkage—e.g., a $—O—(CH_2)_q—O—$ linkage, where q is preferably from 1 to 3. D is halogen, as previously described.

Once the starting material of formula (VI) has been prepared, regardless of the choice of alternative preparation routes described above, it is treated with a strong alkaline reducing agent, such as an alkali borohydride (e.g., lithium, sodium, or potassium borohydride). The reaction product is then acylated with a compound according to formula (X).

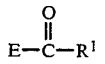

(X)

wherein $R^1$ is as previously defined for formula (V) and

E is halogen or $R^1$—C(O)—O—.

From the values of E, it is apparent that the acylating agent can be either acyl halide, such as acetyl chloride or acetyl bromide, or an acid anhydride, such as acetic anhydride. By noting the appearance of $R^1$ in formulas (V) and (X) it is also apparent that the acyl halide or acid anhydride also provides the 2-position substituent in the protonated tellurazolium salt formed as an ultimate product. The $R^1$ group serves the important purpose of providing a favored reaction site on the tellurazolium ring of the salt ultimately produced. Generally this function is adequately served when $R^1$ is a methyl group, but a wide variety of alternatives can be generated readily, if desired. When the acylating agent is acetyl halide or acetic anhydride, the 2-position substituent is methyl. By varying the acyl halide or acid anhydride employed, the 2-position substituent of the tellurazolium salt can take the form of various hydrocarbon moieties, such as alkyl, cycloalkyl, alkaryl, aryl, aralkyl, and various substituted derivatives, such as those containing alkoxy, alkylthio, halo, amino, amido, and similar substituents.

Though not isolated, it is believed that acylation produces tellurazolines. To avoid opening of the tellurium containing ring, the additional step of producing the stable corresponding protonated tellurazolium salt is undertaken by treatment with a strong nonoxidizing acid, such as any of those mentioned above.

A second process for preparing protonated tellurazolium salts according to formula (V) allows a somewhat more general selection of $R^1$ or 2-position ring substituents as compared to the first process. The starting material employed for this process is represented by formula (XI).

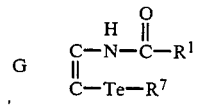

(XI)

wherein

G represents the atoms completing an aromatic nucleus, $R^1$ represents hydrogen, as optionally substituted hydrocarbon moiety, or a —C(O)M group, wherein M is chosen to complete an acid, ester, thioester, or salt, and $R^7$ represents a leaving group.

When the second process is employed, $R^1$ in the starting material of formula (XI) and the protonated tellurazolium salt prepared satisfying formula (V) can include in addition to any of the optionally substituted hydrocarbon moieties discussed above in connection with the first process hydrogen or a —C(O)M group, wherein M is chosen to complete an acid, ester, thioester, or salt (e.g., —C(O)OH, —C(O)$OCH_3$, —C(O)$SCH_3$, or —C(O)ONa). When M completes an ester or thioester, the esterifying moiety can take any of the hydrocarbon or substituted hydrocarbon form(s) previously described by reference to $R^1$.

$R^7$ in formula (XI) forms no part of the protonated tellurazolium salt ultimately produced. Thus, $R^7$ can take the form of any convenient group that can be displaced upon treatment with phosphoryl chloride to permit ring closure. Treatment with phosphoryl chloride eliminates Cl—$R^7$. Thus, any group that can be eliminated as the chloride can be chosen as the leaving group. For example, $R^7$ can be chosen from among the same hydrocarbon moieties described above in connection with $R^1$. Since $R^7$ forms no part of the protonated tellurazolium salt ultimately produced, it is generally most convenient to select $R^7$ from among lower alkyl substituents.

The starting material of formula (XI) can be prepared from known tellurium compounds by several alternative procedures. One preferred approach is to start with a compound according to formula (VI) in which p is zero and Z is —N(R')—, as previously described. This compound is treated with a strong alkaline reducing agent, such as previously described. Thereafter, acylation is performed using an acylating agent according to formula (X), as previously described. This produces the material of formula (XI). To produce the starting material of formula (XI) by another procedure, after treating with a strong alkaline reducing agent, the reaction product is reacted with D—$R^7$, where D is halide, and then acylated with formic acid. In this instance $R^1$ in formula (XI) is hydrogen. By employing other acylating agents $R^1$ can take any one of the other forms of formula (XI).

A third process for preparing a protonated tellurazolium salt according to formula (I) comprises employing a starting material according to formula (XII).

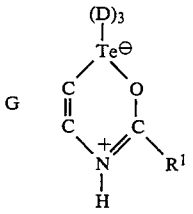

(XII)

wherein

G represents the atoms completing a fused aromatic nucleus, $R^1$ represents an aliphatic or aromatic group comprised of a hydrocarbon moiety optionally linked through a divalent oxy, thio, or carbonyl linkage, an amino group, an amido group, a ureido group, a formamidine disulfide group, or a —C(O)M group, wherein M is chosen to complete an acid, ester, thioester, or salt, and D represents halogen.

D in formula (XII) can be halogen, as previously described. $R^1$ in the starting material of formula (XII) can take an even greater variety of forms than described above in connection with formula (XI). $R^1$ in the starting material of formula (XII) and the protonated tellurazolium salt prepared satisfying formula (V) can include an aliphatic or aromatic group comprised of a hydrocarbon moiety (e.g., alkyl, aryl, alkaryl, or aralkyl moiety) optionally linked through a divalent oxy, thio, or carbonyl linkage (e.g., an alkoxy, aryloxy, alkaryloxy, aralkyloxy, alkylthio, arylthio, alkarylthio, aralkylthio, or acyl moiety); an amino group, including primary, secondary and tertiary amines; an amido group (e.g., acetamido and butryamido); a ureido group (e.g., 1-ureido, 3-phenyl-1-ureido, and 3-methyl-1-ureido); a formamidine disulfide group (e.g., formamidine disulfide and N'-ethyl-N'-methyl-$\alpha$, $\alpha'$-dithiobisformamidine groups); or a —C(O)M group, wherein M is chosen to complete an acid, ester, thioester, or salt (e.g., —C(O)OH, —C(O)$OCH_3$, —C(O)$SCH_3$, or —C(O)ONa). The starting material is reacted with a strong alkaline reducing agent, such as described above, and the resulting product is reacted with a strong nonoxidizing acid, such as also described above, to produce the desired protonated tellurazolium salt. By suitable treatment, (e.g., reduction or hydrolysis), the formamidine disulfide can, if desired, be converted to a thioureido group once the protonated tellurazolium salt has been formed. (The structure of formamidine disulfide is described in *International Union of Pure and Applied Chemistry, Nomenclature of Organic Chemistry,* Buttersworth, London, 1965, Section 951.5.) When $R^1$ is a primary amino group, it is in fact in one tautomeric form an imino group, which provides a highly convenient starting material for the synthesis of azacyanine dyes.

When the compound of formula (XIII) is melted or heated in a suitable solvent (e.g., acetonitrile, butyronitrile, or chloroform) with tellurium tetrachloride or tellurium tetrabromide, the material of formula (XII) is produced.

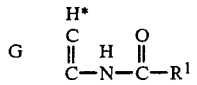

(XIII)

wherein:

H* is an activated hydrogen atom,

G represents the atoms completing an aromatic nucleus, and $R^1$ represents an aliphatic or aromatic group comprised of a hydrocarbon moiety optionally linked through a divalent oxy, thio, or carbonyl linkage, an amino group, an amido group, a ureido group, a formamidine disulfide group, or a —C(O)M group, wherein M is chosen to complete an acid, ester, thioester, or salt.

Heating to a temperature of at least 60° C. up to about 140° C. is contemplated, with temperatures of from about 110° to 120° C. being preferred. In part the reaction to produce the material of formula (XII) is accomplished by choosing G in formula (XIII) so that the aromatic nucleus which it completes is activated in the position ortho to the amido substituent. This can be accomplished by including in the aromatic nucleus one or more substituents capable of directing ring substitution in formula (XIII) to the ring position of the starred activated hydrogen atom. For carbocyclic aromatic rings, such as benzene and naphthene rings, useful substituents can be chosen from among aliphatic and aromatic groups comprised of hydrocarbon moieties (e.g., alkyl, aryl, alkaryl, or aralkyl) optionally linked through a divalent oxygen or sulfur atom (e.g., an alkoxy, aryloxy, alkaryloxy, aralkyloxy, alkylthio, arylthio, alkarylthio, or aralkylthio group); an amino group, including primary, secondary and tertiary amines; an amido group (e.g., acetamido and butyramido); a sulfonamido group (e.g. an alkyl or arylsulfonamido group); a sulfamoyl group (e.g. an alkyl or arylsulfamoyl group); a ureido group (e.g., 1-ureido, 3-phenyl-1-ureido, and 3-methyl-1-ureido); a thioureido group (e.g., a thioureido group corresponding to the above exemplary ureido groups); hydroxy; or a —C(O)M group or —S(O)$_2$M group, wherein M is chosen to complete an acid, ester, thioester, or salt (e.g., —C(O)OH, —C(O)$SCH_3$, —C(O)$OCH_3$, —C(O)ONa, —S(O)$_2$OH, —S(O)$_2OCH_2C_6H_5$, or —S(O)$_2$OLi). The aromatic nucleus completed by G as well as $R^1$ can progress unaltered from the compound of formula (XIII) to the protonated tellurazolium salt forming the desired product.

The anion $Y^1$ shown associated which the protonated tellurazolium salt in formula (V) is usually the anion of the last acid employed in the process. However, it is apparent that conversion from one anion to another can be easily accomplished and that the anion of the tetrazolium salts of this invention can be varied widely.

To obtain the tellurazole corresponding to the protonated tellurazolium salt prepared as described above treatment with a base, such as ammonium hydroxide, an alkali hydroxide, or an alkali carbonate or bicarbonate, can be undertaken. Procedures for performing the same operation on known chalcogenazolium salts are directly applicable. The tellurazole product obtained is generally indicated by formula (XIV)

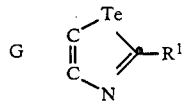

(XIV)

wherein G and $R^1$ correspond to their values in the parent protonated tellurazolium salt.

To convert the tellurazole of formula (XIV) to a corresponding quaternized tellurazolium salt satisfying formula (I), the tellurazole of formula (XIV) is reacted with a quaternizing agent chosen to provide the carbon chain interrupting group required by the invention. In a preferred form the quaternizing agent is a sulfonic acid ester containing the quaternizing radical Q as the base derived moiety of the ester. Specifically preferred quaternizing agents are strong quaternizing agents, such as poly(fluoro)alkylsulfonic acid esters, such as aryl, alkenyl, alkynyl, aralkyl, or alkaryl esters of poly(fluoro)alkylsulfonic acid. Perfluorinated alkylsulfonic acid esters are particularly preferred quaternizing agents (e.g., trifluoromethylsulfonic acid esters). Arylsulfonic acid esters, such as para-toluenesulfonic acid esters, are also strong quaternizing agents. 1,3,2-Dioxathiane-2,2-dioxide and 1,3,2-dioxathiolane-2,2-dioxide have also been demonstrated to be useful quaternizing agents. Including electron donating ring substituents in the aromatic nuclei forming G facilitates quaternization while strongly electron withdrawing substituents require strong quaternizing agents to be employed when quaternization occurs after tellurazole ring formation.

A very advantageous approach for preparing quaternized tellurazolium salts is to employ a starting material according to formula (VI) wherein p is zero, indicated specifically by formula (XV).

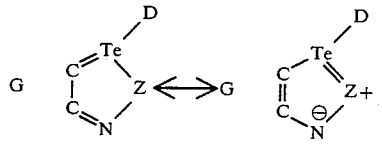

(XV)

wherein

G represents the atoms completing a fused aromatic nucleus,

D is chloride, bromide, or iodide,

Z is —O— or —N(R')—, and

R' is an aromatic nucleus.

The starting material is first treated with a strong alkaline reducing agent, which can be selected from among those described above. The reaction product is then treated with an oxidizing agent, such as oxygen, a peroxide, a disulfide, or a sulfoxide, to produce

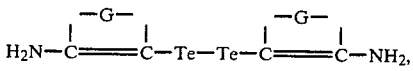

(XVI)

which is treated with an aldehyde, treated with a strong alkaline reducing agent, such as described above, and then treated with an acylating agent according to formula (X), as described above, and a strong nonoxidizing acid, also as described above. Although treatment with an oxidizing agent is preferred, no separate oxidizing step is required. Ambient air will spontaneously perform such oxidation, and treatment with the aldehyde is sufficient in an inert atmosphere.

EXAMPLES

The following examples further illustrate the invention. The structures of the fog-inhibiting agents of the invention and of comparative fog-inhibiting agents are listed in Table I. The letter E is employed to indicate fog-inhibiting agents according to the invention, and the letter C is employed to indicate comparative fog-inhibiting agents.

TABLE I

Structures of the Fog-Inhibiting Agents

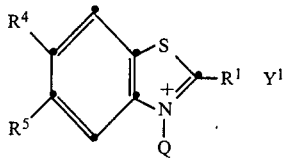

| Compound No. | Q | $R^4$ | $R^5$ | $R^1$ | $Y^1$ |
|---|---|---|---|---|---|
| Comparative compounds: | | | | | |
| FIA-C1 | $CH_3$ | H | H | H | $pts^{\ominus}$* |
| FIA-C2 | $CH_3$ | H | H | $CH_3$ | $pts^{\ominus}$ |
| FIA-C3 | $CH_3$ | $OCH_3$ | $OCH_3$ | H | $pts^{\ominus}$ |
| FIA-C4 | $CH_3$ | H | Cl | $CH_3$ | $pts^{\ominus}$ |
| FIA-C5 | $(CH_2)_3SO_3^{\ominus}$ | H | H | H | — |
| FIA-C6 | $(CH_2)_3SO_3^{\ominus}$ | $OCH_3$ | $OCH_3$ | H | — |
| FIA-C7 | $(CH_2)_3SO_3^{\ominus}$ | H | Cl | $CH_3$ | — |
| FIA-C8 | $CH_2CH(OSO_3^{\ominus})CH_2OSO_3^{\ominus}$ | H | Cl | $CH_3$ | $NH_4^+$ |
| FIA-C9 | $CH_2CH(OSO_3^{\ominus})CH_3^{\ominus}$ | H | Cl | $CH_3$ | — |
| FIA-C10 | $(CH_2)_2PO(OH)_2$ | H | H | H | $Br^{\ominus}$ |
| FIA-C11 | $(CH_2)_3PO(OH)_2$ | H | H | H | $Br^{\ominus}$ |
| FIA-C12 | $CH_2CHOHCH_2OH$ | H | H | H | $Br^{\ominus}$ |
| FIA-C13 | $CH_3$ | H | $SO_3^{\ominus}$ | $CH_3$ | — |
| FIA-C14 | $CH_2CH_3$ | $SO_3^{\ominus}$ | H | $CH_3$ | — |
| FIA-C15 | 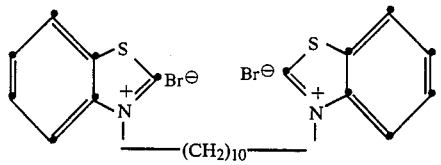 | | | | |
| FIA-C16 | 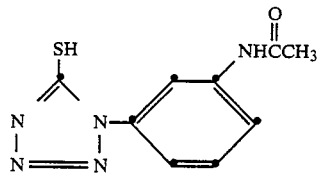 | | | | |
| FIA-C17 | $CH_2CONH_2$ | H | H | H | $I^{\ominus}$ |
| FIA-C18 | $CH_2CONH_2$ | H | H | $CH_3$ | $I^{\ominus}$ |
| FIA-C19 | $CH_2CONH_2$ | H | H | H | $BF_4^{\ominus}$ |
| FIA-E1 | $(CH_2)_2CONHSO_2CH_3$ | H | H | H | $Br^{\ominus}$ |
| FIA-E2 | $(CH_2)_2CONHSO_2CH_3$ | $OCH_3$ | $OCH_3$ | H | $Br^{\ominus}$ |
| FIA-E3 | $(CH_2)_2CONHSO_2CH_3$ | H | Cl | $CH_3$ | $Br^{\ominus}$ |

TABLE I-continued

Structures of the Fog-Inhibiting Agents

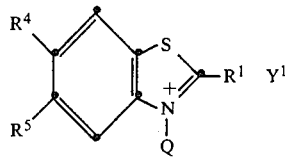

| Compound No. | Q | $R^4$ | $R^5$ | $R^1$ | $Y^1$ |
|---|---|---|---|---|---|
| FIA-E4 | $CH_2CONHSO_2NH_2$ | H | Cl | $CH_3$ | pts⊖ |
| FIA-E5 | $CH_2CONHSO_2NHCOCH_3$ | H | Cl | $CH_3$ | pts⊖ |
| FIA-E6 | $CH_2CONHSO_2NHCOCH_3$ | H | H | $CH_3$ | pts⊖ |

*pts⊖− = p-toluenesulfonate

EXAMPLE 1

Example 1 illustrates the superior speed/fog relationship of FIA-E1, a compound satisfying the requirements of the invention, when compared with N-alkyl, N-sulfoalkyl, N-phosphonoalkyl, or N-hydroxyalkylbenzothiazolium compounds.

On a cellulose acetate support was coated a surface chemically sensitized surface latent image forming fast negative-working silver bromoiodide emulsion, 5.8 mole % iodide, of mean grain size 1.0 μm, at 4.89 g/m² Ag, 11.1 g/m² gelatin. The coating was hardened with bis(vinylsulfonylmethyl) ether at 0.27% of the gelatin weight. Additions of fog-inhibiting agents were made as listed in Table II. Samples of the film were exposed for 1/25 sec through a graduated density tablet to a 5500° K. tungsten source in an EASTMAN 1B Sensitometer, and developed in KODAK DK-50® developer for 5 min at 20° C. Samples were also incubated for two weeks at 49° C., 50% relative humidity (RH), then similarly exposed and processed. The relative speed and fog values are tabulated in Table II.

The sensitometric results show that FIA-E1 satisfying the requirements of the invention is an active fresh and incubation fog-inhibiting agent. Moreover, the speed/fog relationship obtained with FIA-E1 on incubation was clearly superior to that obtained with its N-methyl, FIA-C1; N-sulfopropyl, FIA-C5; N-phosphonoethyl FIA-C10; N-phosphonopropyl, FIA-C11; or N-dihydroxypropyl, FIA-C12, analogs.

TABLE II

Example 1. Sensitometric Results

| Coating No. | Compound | Level mmole/Ag mole | Fresh Rel. Speed | Fresh D-min | 2 Week Incubation Rel. Speed | 2 Week Incubation Δ D-min |
|---|---|---|---|---|---|---|
| 1 | None | — | 100 | .15 | 14 | 1.25 |
| 2 | FIA-Cl | 0.1 | 118 | .15 | 49 | .63 |
| 3 | " | 0.3 | 110 | .14 | 95 | .33 |
| 4 | " | 1.0 | 39 | .11 | 36 | .15 |
| 5 | FIA-C5 | 0.1 | 107 | .13 | 42 | .64 |
| 6 | " | 0.3 | 100 | .09 | 68 | .36 |
| 7 | " | 1.0 | — | — | 83 | .16 |
| 8 | FIA-C10 | 0.1 | 42 | .83 | 100 | .63 |
| 9 | " | 0.3 | 21 | .93 | 85 | .47 |
| 10 | " | 1.0 | 12 | .88 | 26 | .46 |
| 11 | FIA-C11 | 0.1 | 39 | .61 | 76 | .49 |
| 12 | " | 0.3 | 14 | .94 | 94 | .43 |
| 13 | " | 1.0 | 16 | .98 | 25 | .42 |
| 14 | FIA-C12 | 0.1 | 94 | .18 | 78 | .44 |
| 15 | " | 0.3 | 83 | .13 | 71 | .38 |
| 16 | " | 1.0 | 57 | .13 | 57 | .22 |
| 17 | FIA-E1 | 0.1 | 115 | .14 | 97 | .40 |

TABLE II-continued

Example 1. Sensitometric Results

| Coating No. | Compound | Level mmole/Ag mole | Fresh Rel. Speed | Fresh D-min | 2 Week Incubation Rel. Speed | 2 Week Incubation Δ D-min |
|---|---|---|---|---|---|---|
| 18 | " | 0.3 | 118 | .12 | 123 | .22 |
| 19 | " | 1.0 | 87 | .10 | 110 | .12 |

EXAMPLE 2

Example 2 illustrates the speed/fog relationship on incubation of FIA-E2, the 5,6-dimethoxy analog of FIA-E1 of Example 1. FIA-E2 shows superior incubation speed/fog relationship as compared to its N-alkyl and N-sulfoalkyl analogs. The coatings were prepared, exposed, and processed as described for Example 1, with the fog-inhibiting agent addition and sensitometric results listed in Table III.

TABLE III

Example 2. Sensitometric Results

| Coating No. | Compound | Level mmole/Ag mole | Fresh Rel. Speed | Fresh D-min | 2 Week Incubation Rel. Speed | 2 Week Incubation Δ D-min |
|---|---|---|---|---|---|---|
| 1 | None | — | 100 | .13 | 27 | .64 |
| 2 | " | — | 100 | .15 | 35 | .64 |
| 3 | FIA-C3 | 0.3 | 82 | .15 | 42 | .52 |
| 4 | " | 1.0 | 71 | .13 | 40 | .27 |
| 5 | " | 2.0 | 69 | .10 | 47 | .14 |
| 6 | FIA-C6 | 0.3 | 94 | .13 | 35 | .62 |
| 7 | " | 1.0 | 80 | .14 | 38 | .46 |
| 8 | " | 2.0 | 76 | .14 | 37 | .38 |
| 9 | FIA-E2 | 0.3 | 82 | .15 | 42 | .49 |
| 10 | " | 1.0 | 65 | .14 | 46 | .25 |
| 11 | " | 2.0 | 67 | .10 | 52 | .13 |

EXAMPLE 3

Example 3 illustrates the fresh and incubation speed/fog relationship of FIA-E3 of the invention, the 2-methyl-5-chloro analog of FIA-E1 of the invention, as well as additional data for FIA-E1. Comparisons are made with N-alkyl and sulfoalkyl analogs. The coatings were prepared, exposed, and processed as for the previous examples, and the results are tabulated in Table IV.

TABLE IV

Example 3. Sensitometric Results

| Coating No. | Compound | Level mmole/Ag mole | Fresh Rel. Speed | Fresh D-min | 2 Week Incubation Rel. Speed | 2 Week Incubation Δ D-min |
|---|---|---|---|---|---|---|
| 1 | None | — | 100 | 0.11 | 36 | 0.42 |
| 2 | " | — | 91 | 0.10 | 35 | 0.42 |
| 3 | FIA-C8 | 0.1 | 91 | 0.09 | 43 | 0.31 |
| 4 | " | 0.3 | 83 | 0.08 | 33 | 0.25 |
| 5 | " | 1.0 | 80 | 0.07 | 39 | 0.18 |
| 6 | FIA-C9 | 0.1 | 95 | 0.09 | 41 | 0.31 |
| 7 | " | 0.3 | 83 | 0.08 | 71 | 0.19 |
| 8 | " | 1.0 | 59 | 0.06 | 48 | 0.09 |
| 9 | FIA-C7 | 0.1 | 91 | 0.09 | 68 | 0.29 |
| 10 | " | 0.3 | 83 | 0.08 | 68 | 0.19 |
| 11 | " | 1.0 | 63 | 0.07 | 36 | 0.10 |
| 12 | FIA-C4 | 0.1 | 94 | 0.09 | 65 | 0.30 |
| 13 | " | 0.3 | 80 | 0.09 | 48 | 0.19 |
| 14 | " | 1.0 | 55 | 0.07 | 38 | 0.09 |
| 15 | FIA-C2 | 0.1 | 100 | 0.10 | 35 | 0.36 |
| 16 | " | 0.3 | 95 | 0.09 | 35 | 0.30 |
| 17 | " | 1.0 | 87 | 0.08 | 76 | 0.17 |
| 18 | FIA-C1 | 0.1 | 91 | 0.09 | 65 | 0.26 |
| 19 | " | 0.3 | 80 | 0.08 | 62 | 0.18 |
| 20 | " | 1.0 | 47 | 0.06 | 27 | 0.09 |
| 21 | FIA-E3 | 0.1 | 89 | 0.09 | 34 | 0.29 |
| 22 | " | 0.3 | 78 | 0.08 | 63 | 0.15 |
| 23 | " | 1.0 | 63 | 0.06 | 35 | 0.06 |
| 24 | FIA-E1 | 0.1 | 87 | 0.09 | 68 | 0.24 |
| 25 | " | 0.3 | 80 | 0.07 | 62 | 0.13 |
| 26 | " | 1.0 | 73 | 0.07 | 47 | 0.07 |

These results again show the superior speed/fog relationship of FIA-E1 and FIA-E3 satisfying the invention as compared to that obtainable with N-alkyl and sulfoalkyl analogs.

EXAMPLE 4

Example 4 again illustrates the superior speed/fog relationship of FIA-E3 of the invention, as well as that of the amino-substituted analog FIA-E4 and the acetamido-substituted analogs FIA-E5 and FIA-E6.

The coatings of Example 4 were prepared, exposed and processed as described for the previous examples, except that the hardener level was raised to 1.75% of the gelatin weight. The fog-inhibiting agent additions and sensitometric results are listed in Table V.

TABLE V

Example 4. Sensitometric Results

| Coating No. | Compound | Level mmol/Ag mole | Fresh Rel. Speed | Fresh D-min | 2 Week Incubation Rel. Speed | 2 Week Incubation Δ D-min |
|---|---|---|---|---|---|---|
| 1 | None | — | 100 | .06 | 57 | .25 |
| 2 | " | — | 107 | .06 | 78 | .19 |
| 3 | FIA-C4 | 0.1 | 102 | .06 | 89 | .14 |
| 4 | " | 0.3 | 85 | .05 | 73 | .09 |
| 5 | " | 1.0 | 55 | .04 | 30 | .08 |
| 6 | FIA-E3 | 0.1 | 120 | .05 | 82 | .14 |
| 7 | " | 0.3 | 110 | .05 | 73 | .12 |
| 8 | " | 1.0 | 91 | .05 | 82 | .08 |
| 9 | FIA-E4 | 0.1 | 83 | .05 | 59 | .09 |
| 10 | " | 0.3 | 74 | .05 | 62 | .08 |
| 11 | " | 1.0 | 76 | .04 | 45 | .08 |
| 12 | FIA-E5 | 0.1 | 94 | .05 | 69 | .14 |
| 13 | " | 0.3 | 80 | .05 | 63 | .09 |
| 14 | " | 1.0 | 76 | .05 | 35 | .09 |
| 15 | FIA-E6 | 0.1 | 105 | .05 | 58 | .15 |
| 16 | " | 0.3 | 91 | .06 | 73 | .11 |
| 17 | " | 1.0 | 89 | .05 | 53 | .09 |

The results show FIA-E3, FIA-E4, FIA-E5, and FIA-E6 satisfying the invention to provide a superior speed/fog relationship to that provided by FIA-C4.

EXAMPLE 5

Example 5a

Example 5a shows the superior speed/fog relationship obtained with FIA-E1 satisfying the invention as compared to its N-methyl and N-sulfopropyl analogs, in this case in a spectrally sensitized, dye-forming coupler containing chlorobromide emulsion system. FIA-E1 also provides results superior to those obtained with an alternative fog-inhibiting agent combination used as the control for this emulsion system.

On a resin-coated paper support was coated a gelatin pad at 1.08 g/m$^2$. Over this was coated an optimally sulfur-sensitized cubic grain surface latent image forming negative-working silver chlorobromide emulsion containing 15% chloride and of mean grain size about 0.3 μm, spectrally sensitized with 240 mg/Ag mole of the green-sensitizing dye anhydro-5-chloro-9-ethyl-5'-phenyl-3'-(3-sulfobutyl)-3-(3-sulfopropyl)oxacarbocyanine hydroxide, triethylamine salt. The emulsion was coated at 0.32 g/m$^2$ Ag and 1.66 g/m$^2$ gelatin, and also contained 0.43 g/m$^2$ of the magenta dye-forming coupler, 1-(2,4,6-trichlorophenyl)-3-{5-[α-(3-t-butyl-4-hydroxy phenoxy)tetradecaneamido]-2-chloroanilino}-5-pyrazolone. Over the emulsion layer was coated a protective layer containing 1.08 g/m$^2$ gelatin. The coating was hardened with bis(vinylsulfonylmethyl) ether at 1.75% of the total weight of gelatin. Fog-inhibiting agents were added to the emulsion as indicated in Table VI.

Samples of the coatings were exposed through a step wedge in an EASTMAN 1B® sensitometer for 1/10" to a 3000° K. source filtered with Wratten ®W12+2C filters to provide a minus blue exposure. The samples were then processed in the KODAK EKTAPRINT ®2 process, with development for 3½ min at 33° C. Samples were also incubated for two weeks at 49° C., 50% RH, then similarly exposed and processed.

The resulting relative speeds and D-min values are shown in Table VI. Incubation Δ D-min was determined by comparison with samples held at −18° C. Inspection of the data shows the superior fresh speed/fog relationship obtained with FIA-E1 satisfying the invention when compared with FIA-C1 (N-methyl analog), with FIA-C5 (N-sulfopropyl analog) or with the alternative fog-inhibiting agent combination of FIA-C15+FIA-C16. The superior prevention of D-min growth on incubation by the fog-inhibiting agent satisfying the invention is also apparent.

TABLE VI

Example 5a. Sensitometric Results

| Coating No. | Compound | Level mmole/Ag mole | Fresh Rel. Speed | Fresh D-min | 2 Week Incubation Rel. Speed | 2 Week Incubation Δ D-min |
|---|---|---|---|---|---|---|
| 1 | FIA-Cl | .08 | 100 | .12 | 148 | +.085 |
| 2 | " | .34 | 110 | .11 | 162 | +.055 |
| 3 | " | .67 | 112 | .10 | 170 | +.02 |
| 4 | FIA-C5 | .09 | 97 | .12 | 148 | +.095 |
| 5 | " | .34 | 102 | .12 | 145 | +.045 |
| 6 | " | .68 | 94 | .11 | 132 | +.02 |
| 7 | FIA-C15 + '-C16 | .18 + .77 | 82 | .10 | 100 | +.02 |
| 8 | FIA-E1 | .41 | 123 | .10 | 166 | +.03 |
| 9 | " | .55 | 123 | .10 | 174 | +.015 |
| 10 | " | .68 | 129 | .10 | 178 | +.015 |

Example 5b

Example 5b illustrates the superior fog-inhibiting agent properties of FIA-E3, a 2-methyl-5-chloro compound of the invention, when compared with its N-methyl and N-sulfopropyl analogs. A comparison is also made with 5- and 6-sulfo substituted benzothiazolium compounds as additional control compounds.

The coating preparation, exposure and processing were as described for Example 5a. Each of the fog-inhibiting agents (with the exception of FIA-C15+FIA-C16) was dissolved in water containing one equivalent of sodium hydroxide, based on the amount of fog-inhibiting agent used. The fog-inhibiting agent addition and sensitometric results are listed in Table VII.

TABLE VII

Example 5b. Sensitometric Results

| Coating No. | Compound | Level mmole/Ag mole | Fresh Rel. Speed | Fresh D-min | 2 Week Incubation Rel. Speed | 2 Week Incubation Δ D-min |
|---|---|---|---|---|---|---|
| 1 | FIA-C4 | .56 | 100 | .12 | 155 | +.045 |
| 2 | " | 1.11 | 94 | .12 | 135 | +.02 |
| 3 | FIA-C7 | .56 | 112 | .11 | 148 | +.035 |
| 4 | " | 1.11 | 89 | .10 | 105 | +.015 |
| 5 | FIA-C13 | .56 | 110 | .11 | 138 | +.035 |
| 6 | " | 1.11 | 97 | .10 | 110 | +.015 |
| 7 | FIA-C14 | .56 | 107 | .11 | 141 | +.05 |
| 8 | " | 1.11 | 110 | .11 | 145 | +.055 |
| 9 | FIA-C15 4'-C16 | .18 + .77 | 76 | .09 | 95 | +.02 |
| 10 | FIA-E3 | .56 | 123 | .09 | 174 | +.015 |
| 11 | " | 1.11 | 118 | .09 | 151 | +.015 |

These results show that the 2-methyl-5-chloro compound satisfying the invention, FIA-E3, provides a superior speed/fog relationship both fresh and incubated when compared to the N-methyl, FIA-C4, and N-sulfopropyl, FIA-C7, control compounds; FIA-C3 is also superior to the two benzene-ring sulfo-substituted compounds, FIA-C13, and FIA-C14. Once again, the compound satisfying the invention is superior in its speed/fog relationship to the alternative fog-inhibiting agent combination, FIA-C15+FIA-C16.

EXAMPLE 6

Example 6 illustrates the superior speed/fog relationships obtained with FIA-E1 satisfying the invention when compared to its N-carbamoyl analogs.

The coatings were prepared and tested as described in Example 5a. The fog-inhibiting agents were added as indicated in Table VIII. All fog-inhibiting agents were dissolved in water for addition to the emulsion with the following exceptions: FIA-C18 was hydrolyzed by the addition of 1 equivalent of NaOH/mole of fog-inhibiting agent; the control fog-inhibiting agent FIA-C15 was dissolved in methanol; and the control fog-inhibiting agent FIA-C16 was dissolved in water plus 1 equivalent/mole fog-inhibiting agent of NaOH added for solubilization.

Coatings 1 and 2 contain a compound satisfying the invention, FIA-E1. Coatings 3 and 4 also contain FIA-E1 but with the addition of KI at 1 equivalent/mole FIA-E1 for comparison with the iodide counterions of FIA-C17 and FIA-C18. Coatings 5 and 6 contain FIA-C17, the N-carbamoylmethyl analog of FIA-E1. Coatings 7 and 8 contain FIA-C18, the 2-methyl analog of FIA-C17. Coatings 9 and 10 contain FIA-C19, where the iodide counterion of FIA-C17 is replaced with tetrafluoroborate. Finally coatings 11 and 12 contain the control fog-inhibiting agent combination FIA-C15+FIA-C16, as included also in Examples 5a and 5b.

TABLE VIII

Example 6. Sensitometric Results

| Coating No. | Compound | Level mmole/Ag mole | Fresh Rel. Speed | Fresh D-min | 2 Week Incubation Rel. Speed | 2 Week Incubation Δ D-min |
|---|---|---|---|---|---|---|
| 1 | FIA-E1 | 0.68 | 100 | .11 | 138 | +.02 |
| 2 | " | 0.82 | 100 | .11 | 138 | +.02 |
| 3 | FIA-E1 + KI | 0.68 | 110 | .11 | 155 | +.02 |
| 4 | " | 0.82 | 120 | .11 | 162 | +.015 |
| 5 | FIA-C17 | 0.68 | 73 | .10 | 107 | +.02 |
| 6 | " | 0.82 | 74 | .11 | 107 | +.015 |
| 7 | FIA-C18 | 0.69 | 94 | .10 | 132 | +.025 |
| 8 | " | 0.82 | 95 | .11 | 135 | +.02 |
| 9 | FIA-C19 | 0.69 | 78 | .10 | 112 | +.015 |
| 10 | " | 0.82 | 74 | .11 | 107 | +.02 |
| 11 | FIA-C15 + '-C16 | 0.18 + .77 | 58 | .11 | 68 | +.02 |

TABLE VIII-continued

Example 6. Sensitometric Results

| Coating No. | Compound | Level mmole/Ag mole | Fresh Rel. Speed | Fresh D-min | 2 Week Incubation Rel. Speed | 2 Week Incubation Δ D-min |
|---|---|---|---|---|---|---|
| 12 | " | 0.18 + .77 | 58 | .10 | 71 | +.015 |

The resulting relative speeds and D-min values are tabulated in Table VIII. The fresh speed of Coating 1, containing FIA-E1 satisfying the invention at 0.68 mmole/Ag mole, is taken as 100. Addition of KI in Coatings 3 and 4 resulted in increased speed. Comparison of Coatings 5–8 with Coatings 1–4 shows that FIA-E1 has a superior fresh and incubation speed/fog relationship to those of FIA-C17 and FIA-C18, particularly when coatings containing equivalent amounts of iodide are considered. FIA-C19 ($BF_4^{\ominus}$) also is clearly poorer in its speed/fog relationship than FIA-E1. The control fog-inhibiting agents combination FIA-C15+FIA-C16 is again inferior in its speed/fog relationships.

The invention has been described in detail with particular reference to preferred embodiments thereof, but it will be understood that variations and modifications can be effected within the spirit and scope of the invention.

What is claimed is:

1. A photographic element containing a radiation sensitive silver halide emulsion and a fog inhibiting, speed/fog relationship enhancing amount of a hydrolyzed quaternized chalcogenazolium salt of a middle chalcogen including a quaternizing substituent having the formula:

$$-L-T\overset{H}{(}N-T^1)_m R$$

where:

L is a divalent linking group;

R is a hydrocarbon residue or an amino group;

T and $T^1$ are independently carbonyl or sulfonyl and m is an integer of from 1 to 3.

2. A photographic element according to claim 1 further characterized in that said silver halide emulsion contains surface latent image forming silver halide grains.

3. A photographic element according to claim 2 further characterized in that said silver halide grains are surface chemically sensitized.

4. A photographic element according to claim 2 further characterized in that said silver halide grains are spectrally sensitized.

5. A photographic element according to claim 1 further characterized in that said hydrolyzed quaternized chalcogenazolium salt is comprised of a hydrolyzed chalcogenazolium ring fused with a carbocyclic aromatic nucleus.

6. A photographic element according to claim 5 further characterized in that said middle chalcogen atom is a tellurium atom.

7. A photographic element according to claim 1 further characterized in that said middle chalcogen atom is a sulfur or selenium atom.

8. A photographic element according to claim 1 further characterized in that T is a carbonyl group.

9. A photographic element according to claim 8 further characterized in that m is 1.

10. A photographic element according to claim 1 further characterized in that said fog-inhibiting agent is present in a concentration of from 10.0 to 0.01 mollimole per silver mole.

11. A photographic element containing a radiation sensitive silver halide emulsion and a fog inhibiting, speed/fog relationship enhancing amount in the range of from 2.0 to 0.015 millimole per silver mole of a hydrolyzed quaternized chalcogenazolium salt satisfying the formula:

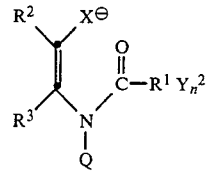

wherein $R^1$ is hydrogen, alkyl of from 1 to 8 carbon atoms, or aryl of from 6 to 10 carbon atoms;

$R^2$ and $R^3$ are independently hydrogen or halogen atoms; aliphatic or aromatic hydrocarbon moieties optionally linked through a divalent oxygen or sulfur atom; or cyano, amino, amido, sulfonamido, sulfamoyl, ureido, thioureido, hydroxy, —C(O)M, or —$S(O)_2M$ groups, wherein M is chosen to complete an aldehyde, ketone, acid, ester, thioester, amide, or salt; or $R^2$ and $R^3$ together represent the atoms completing a fused ring;

$Y^2$ represents a charge balancing counter ion;

n is the integer 0 or 1;

X is a middle chalcogen atom; and

Q is a quaternizing substituent satisfying the formula:

$$-L-T\overset{H}{(}N-T^1)_m R$$

wherein

L represents an optionally substituted divalent hydrocarbon group;

R represents an amino group or an optionally substituted hydrocarbon residue;

T is carbonyl or sulfonyl;

$T^1$ is independently in each occurrence carbonyl or sulfonyl; and m is an integer of from 1 to 3.

12. A photographic element according to claim 11 further characterized in that L is an alkylene group of from 1 to 8 carbon atoms.

13. A photographic element according to claim 11 further characterized in that R is a primary or secondary amino group, an alkyl group of from 1 to 8 carbon atoms, or an aryl group of from 6 to 10 carbon atoms.

14. A photographic element according to claim 11 further characterized in that T is carbonyl.

15. A photographic element according to claim 11 further characterized in that $R^2$ and $R^3$ together complete a fused carbocyclic ring and X is tellurium.

16. A photographic element according to claim 11 further characterized in that X is sulfur or selenium.

17. A photographic element comprised of a radiation sensitive silver halide emulsion containing a fog inhibiting, speed/fog relationship enhancing amount in the range of from 2.0 to 0.015 millimole per silver mole of a hydrolyzed quaternized thiazolium salt satisfying the formula:

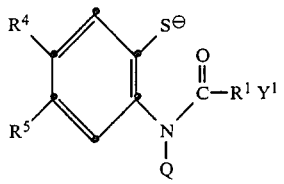

wherein $R^1$ is hydrogen, alkyl of from 1 to 8 carbon atoms, or aryl of from 6 to 10 carbon atoms;

$R^4$ and $R^5$ are independently hydrogen or halogen atoms; aliphatic or aromatic hydrocarbon moieties optionally linked through a divalent oxygen or sulfur atom; or cyano, amino, amido, sulfonamido, sulfamoyl, ureido, thioureido, hydroxy, —C(O)M, or —$S(O)_2M$ groups, wherein M is chosen to complete an aldehyde, ketone, acid, ester, thioester, amide, or salt;

$Y^1$ is a charge balancing counter ion; and

Q is a quaternizing substituent of the formula —L-$CONHSO_2R$, —$LCONHSO_2NH_2$, or —$LCONHSO_2NHCOR$ wherein L is an alkylene group of from 1 to 8 carbon atoms and R is an alkyl group of from 1 to 8 carbon atoms or a primary amino group.

18. A photographic element according to claim 17 in which $R^1$ is hydrogen or methyl; $R^4$ and $R^5$ are individually hydrogen, halogen, or alkyl or alkoxy groups of from 1 to 4 carbon atoms; and L is methylene or ethylene.

* * * * *